US011131161B2

(12) United States Patent
Fripp et al.

(10) Patent No.: US 11,131,161 B2
(45) Date of Patent: Sep. 28, 2021

(54) SHUTTLE VALVE FOR AUTONOMOUS FLUID FLOW DEVICE

(71) Applicant: Halliburton Energy Services, Inc., Houston, TX (US)

(72) Inventors: Michael Linley Fripp, Carrollton, TX (US); Stephen Michael Greci, Little Elm, TX (US); Hadi Arabnejad Khanouki, Dallas, TX (US); Ibrahim El Mallawany, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 230 days.

(21) Appl. No.: 16/440,558

(22) Filed: Jun. 13, 2019

(65) Prior Publication Data

US 2020/0063518 A1 Feb. 27, 2020

Related U.S. Application Data

(60) Provisional application No. 62/721,829, filed on Aug. 23, 2018.

(51) Int. Cl.
*E21B 33/068* (2006.01)
*E21B 34/02* (2006.01)

(52) U.S. Cl.
CPC ..... *E21B 33/068* (2013.01); *E21B 34/02* (2013.01)

(58) Field of Classification Search
CPC ..... E21B 43/12; E21B 34/08; E21B 33/068; E21B 34/02; Y10T 137/7792
See application file for complete search history.

(56) References Cited

U.S. PATENT DOCUMENTS

| | | | | |
|---|---|---|---|---|
| 9,309,745 | B2 * | 4/2016 | Patel | E21B 34/10 |
| 9,404,339 | B2 * | 8/2016 | Dykstra | E21B 34/08 |
| 9,453,395 | B2 | 9/2016 | Fripp et al. | |
| 10,704,359 | B2 * | 7/2020 | Fripp | E21B 43/12 |
| 2006/0076150 | A1 | 4/2006 | Coronado et al. | |

(Continued)

FOREIGN PATENT DOCUMENTS

| | | |
|---|---|---|
| WO | 2010056977 | 5/2010 |
| WO | 2012145735 | 10/2012 |

(Continued)

OTHER PUBLICATIONS

International Search Report for Application No. PCT/US2019/037119 dated Sep. 26, 2019.

*Primary Examiner* — Jessica Cahill
(74) *Attorney, Agent, or Firm* — Scott Richardson; C. Tumey Law Group PLLC

(57) ABSTRACT

A fluid control system may comprise a flow control device including one or more floats attached within the flow control device, an outlet within the flow control device that is connected to the one or more floats, a regulatory valve that is fluidly connected to the flow control device, and a blocking element placed within the regulatory valve. An autonomous flow control system may comprise a first flow control device attached to a production tubing at a first location in a wellbore, a second flow control device attached to the production tubing at a second location in the wellbore, a first set of floats attached within the first flow control device, and a second set of floats attached within the second flow control device.

20 Claims, 12 Drawing Sheets

(56) References Cited

U.S. PATENT DOCUMENTS

| | | | | |
|---|---|---|---|---|
| 2008/0041580 | A1* | 2/2008 | Freyer | E21B 43/12 166/193 |
| 2009/0277650 | A1 | 11/2009 | Casciaro et al. | |
| 2013/0068467 | A1* | 3/2013 | Zhou | E21B 43/12 166/369 |
| 2013/0092393 | A1* | 4/2013 | Dykstra | E21B 43/12 166/373 |
| 2014/0041731 | A1 | 2/2014 | Fripp et al. | |
| 2015/0000751 | A1* | 1/2015 | Nicholson | F16K 1/22 137/2 |
| 2015/0107848 | A1* | 4/2015 | Leitch | F04B 47/00 166/373 |
| 2015/0308226 | A1* | 10/2015 | Killie | E21B 34/10 166/373 |
| 2016/0258252 | A1 | 9/2016 | Fripp et al. | |
| 2016/0305216 | A1* | 10/2016 | Fripp | E21B 34/08 |
| 2017/0260829 | A1* | 9/2017 | Aadnoy | F16K 33/00 |
| 2019/0120048 | A1* | 4/2019 | Coffin | E21B 43/12 |

FOREIGN PATENT DOCUMENTS

| | | |
|---|---|---|
| WO | 2018093516 | 5/2018 |
| WO | 2019078821 | 4/2019 |

* cited by examiner

SHUTTLE VALVE FOR AUTONOMOUS FLUID FLOW DEVICE

BACKGROUND

In hydrocarbon production wells, it may be beneficial to regulate the flow of formation fluids from a subterranean formation into a wellbore penetrating the same. A variety of reasons or purposes may necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices may be non-discriminating for different types of formation fluids and may simply function as a "gatekeeper" for regulating access to the interior of a wellbore pipe, such as a well string. Such gatekeeper devices may be simple on/off valves or they may be metered to regulate fluid flow over a continuum of flow rates. Other types of devices for regulating the flow of formation fluids may achieve at least some degree of discrimination between different types of formation fluids. Such devices may include, for example, tubular flow restrictors, nozzle-type flow restrictors, autonomous inflow control devices, non-autonomous inflow control devices, ports, tortuous paths, combinations thereof, and the like.

Autonomous flow control devices may be particularly advantageous in subterranean operations, since they are able to automatically regulate fluid flow without the need for operator control due to their design. In this regard, autonomous flow control devices may be designed such that they provide a greater resistance to the flow of undesired fluids (e.g., gas and/or water) than they do desired fluids (e.g., oil), particularly as the percentage of the undesired fluids increases.

While autonomous flow control devices may operate in a passive fashion, it may be desirable to limit the flow of an undesired fluid into the interior of a production tubing string. For example, oftentimes, the ratio of oil-to-water in a stimulated fluid may be less than optimal.

BRIEF DESCRIPTION OF THE DRAWINGS

These drawings illustrate certain aspects of some examples of the present disclosure and should not be used to limit or define the disclosure.

DETAILED DESCRIPTION

Provided are systems and methods for controlling the fluid flow into an interior of a production tubing string from the surrounding formations. As discussed below, design features may include the addition of a shuttle valve between the autonomous flow control device and the production tubing string. In examples, the shuttle valve may selectively restrict any fluid flow through the outlet flow ports of the autonomous flow control device into the production tubing string.

Figure 1:
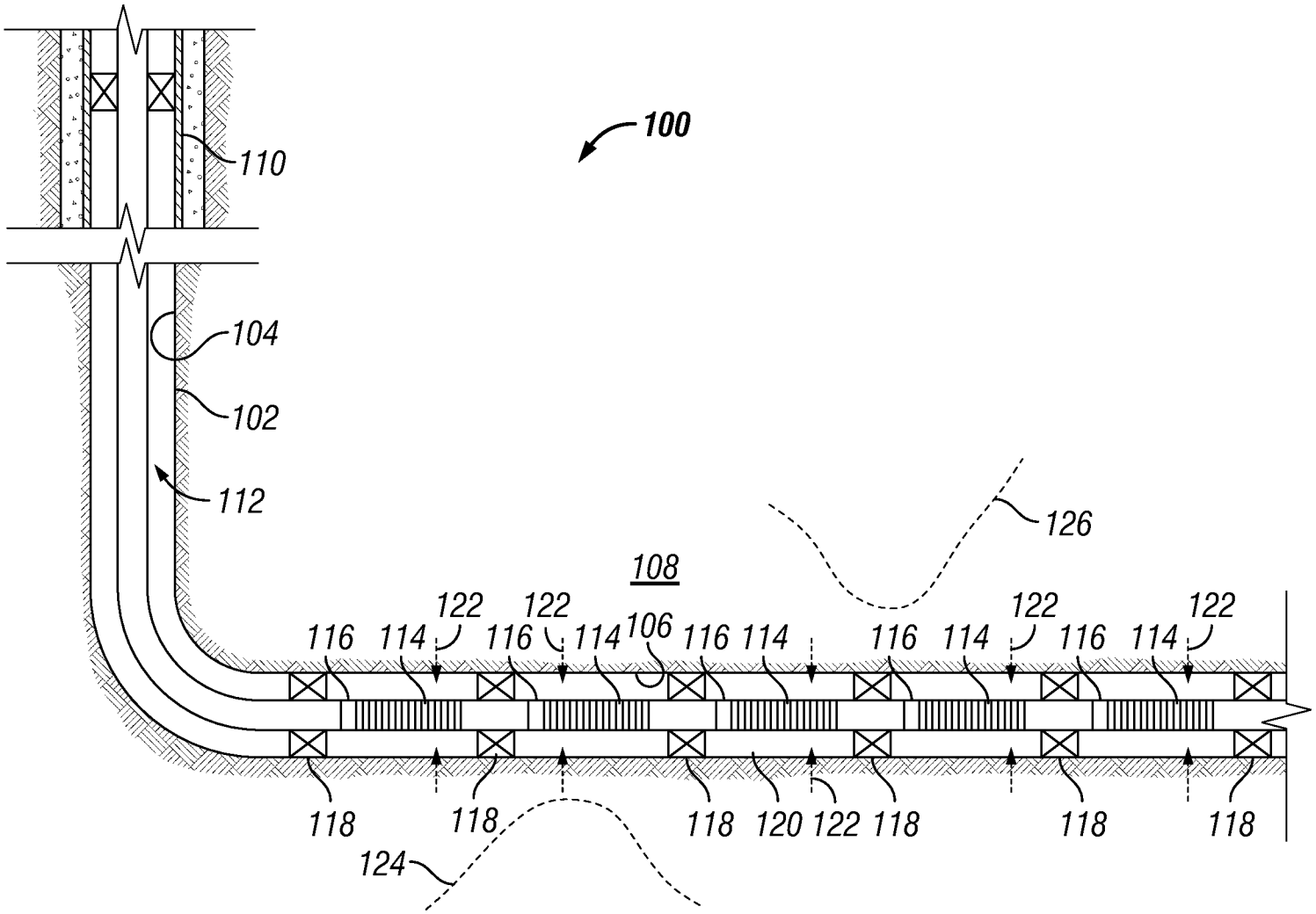
FIG. 1 illustrates an example of a well system.

FIG. 1 illustrates a well system 100 which may embody principles of the present disclosure, according to one or more examples. As illustrated, well system 100 may include a wellbore 102 that includes a generally vertical section 104, which is uncased, that may transition into a generally horizontal section 106, which is uncased, extending through a subterranean formation 108. In some examples, vertical section 104 may extend downwardly from a portion of wellbore 102 having a string of casing 110 cemented therein. A tubular string, such as production tubing 112, may be installed in or otherwise extended into wellbore 102.

As depicted, a plurality of well screens 114, flow control devices 116, and packers 118 may be interconnected along production tubing 112, such as along portions of the production tubing 112 in horizontal section 106 of wellbore 102. Packers 118 may be configured to seal off an annulus 120 defined between production tubing 112 and the walls of wellbore 102. As a result, fluids 122 may be produced from multiple intervals of the surrounding subterranean formation 108 via isolated portions of annulus 120 between adjacent pairs of packers 118.

As illustrated, in some examples, a well screen 114 and a flow control device 116 may be interconnected in production tubing 112 and positioned between a pair of packers 118. Without limitation, well screens 114 may be swell screens, wire wrap screens, mesh screens, sintered screens, expandable screens, pre-packed screens, treating screens, or other known screen types. In operation, well screen 114 may be configured to filter fluids 122 flowing into production tubing 112 from annulus 120. Flow control device 116 may be configured to restrict or otherwise regulate the flow of fluids 122 into production tubing 112, based on certain physical characteristics of the fluids. In examples, flow control device 116 may be a centrifugal fluid selector, wherein a portion of the centrifugal fluid selector may be actuated to rotate by the flow of fluids 122.

Without limitation, flow control device 116 may be an autonomous flow control device. The autonomous flow control device may utilize fluid dynamics and delay the flow of unwanted fluids such as water and/or gas into the interior of production tubing 112. The autonomous flow control device may operate as a passive flow control device, not requiring moving components and/or electronics. The autonomous flow control device may be any suitable shape. Without limitation, a suitable shape may include, but is not limited to, cross-sectional shapes that are circular, elliptical, triangular, rectangular, square, hexagonal, and/or combinations thereof. The autonomous flow control device may be made from any suitable material. Suitable materials may include, but are not limited to, metals, nonmetals, polymers, ceramics, and/or combinations thereof. Without limitation, the autonomous flow control device may be made from tungsten carbide and/or steel.

It will be appreciated that well system 100 is merely one example of a wide variety of well systems in which the principles of this disclosure may be utilized. Accordingly, it should be understood that the principles of this disclosure are not necessarily limited to any of the details of the depicted well system 100, or the various components thereof, depicted in the drawings or otherwise described herein. For example, it is not necessary in keeping with the principles of this disclosure for wellbore 102 to include a generally vertical section 104 or a generally horizontal section 106. Moreover, it is not necessary for fluids 122 to be only produced from subterranean formation 108 since, in other examples, fluids may be injected into subterranean formation 108, or fluids 122 may be both injected into and produced from subterranean formation 108, without departing from the scope of the disclosure.

Furthermore, it is not necessary that at least one well screen 114 and flow control device 116 be positioned between a pair of packers 118. Nor is it necessary for a single flow control device 116 to be used in conjunction with a single well screen 114. Rather, any number, arrangement and/or combination of such components may be used, without departing from the scope of the disclosure. In some applications, it is not necessary for flow control device 116 to be used with a corresponding well screen 114. For example, in injection operations, the injected fluid could be flowed through flow control device 116, without also flowing through well screen 114.

Those skilled in the art will readily recognize the advantages of being able to regulate the flow of fluids 122 into production tubing 112 from each zone of subterranean formation 108, for example, to prevent water coning 124 or gas coning 126 in subterranean formation 108. Other uses for flow regulation in a well may include, but are not limited to, balancing production from (or injection into) multiple zones, minimizing production or injection of undesired fluids, maximizing production or injection of desired fluids, etc.

Figure 2:
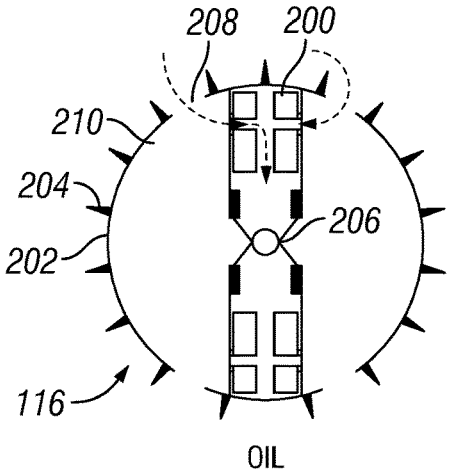
FIG. 2 illustrates a schematic view showing the positions of floats as a flow control device operates.
Figure 3:
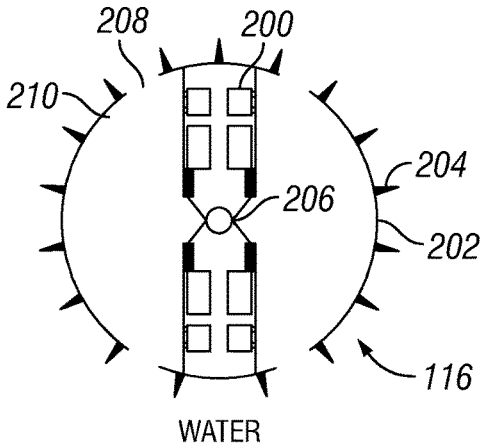
FIG. 3 illustrates a schematic view showing the positions of floats as a flow control device operates.
Figure 4:
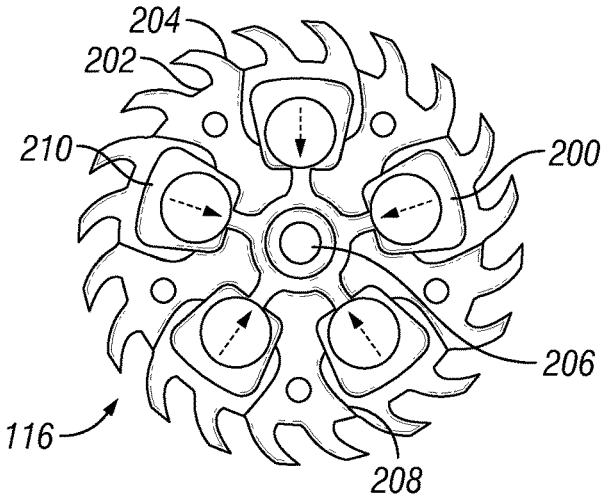
FIG. 4 illustrates an example flow control device with circular floats.
Figure 5:
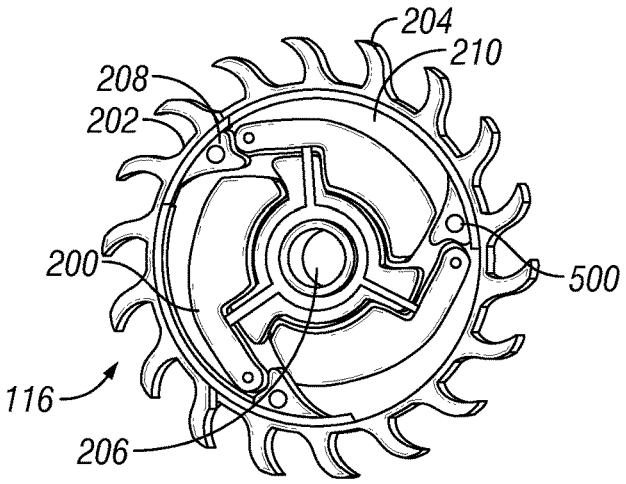
FIG. 5 illustrates an example flow control device with hinged floats.

FIGS. 2-5 illustrate different views of flow control device 116. FIGS. 2 and 3 depict a schematic view showing the positions of floats 200 as flow control device 116 operates. FIGS. 4 and 5 illustrate various examples flow control devices 116 with different arrangements for floats 200. Flow control device 116 may be designed to regulate the flow of fluids 122 (i.e., referring to FIG. 1) into production tubing 112 (i.e., referring to FIG. 1). Flow control device 116 may include a housing 202, protrusions 204, an outlet 206, and floats 200.

In examples, housing 202 may be any suitable size, height, and/or shape. Without limitation, a suitable shape may include, but is not limited to, cross-sectional shapes that are circular, elliptical, triangular, rectangular, square, hexagonal, and/or combinations thereof. In certain examples, housing 202 may be circular. Housing 202 may encase the internal components of flow control device 116. In examples, housing 202 may protect the internal components of flow control device 116 from an external environment. In certain examples, housing 202 may include protrusions 204.

Protrusions 204 may be extensions of material from the diameter of housing 202. In examples, protrusions 204 may be any suitable size, height, and/or shape. Without limitation, a suitable shape may include, but is not limited to, cross-sectional shapes that are circular, elliptical, triangular, rectangular, square, hexagonal, and/or combinations thereof. In certain examples, protrusions 204 may visually appear and physically operate similarly to teeth on a mechanical gear.

In alternate examples, protrusions 204 may be extensions of material from a ring of material that is coupled to housing 202. In these examples, the inner diameter of the ring of material may be equal to or larger than the diameter of housing 202. Depending on the inner diameter of the ring of material, there may or may not be an annulus between the ring of material and housing 202. During operations of flow control device 116, a portion of flow control device 116 may be disposed within a flow path of fluids 122 (i.e., referring to FIG. 1). In examples, the flow of fluids 122 may interact with protrusions 204. As the pressure of fluids 122 increases at a contact point between fluids 122 and protrusions 204, protrusions 204 may be actuated to rotate. In certain examples, housing 202 may rotate along with protrusions 204. In alternate examples, housing 202 may remain stationary as protrusions 204 rotate around housing 202.

In examples, there may be an opening 208 between protrusions 204 that allows access to an internal chamber 210 of housing 202. There may be a plurality of openings 208 that allow fluids 122 to flow from the flow path, between a set of protrusions 204, and into internal chamber 210. In examples, internal chamber 210 may be any suitable size, height, and/or shape. Without limitation, a suitable shape may include, but is not limited to, cross-sectional shapes that are circular, elliptical, triangular, rectangular, square, hexagonal, and/or combinations thereof. Internal chamber 210 may include various structures and/or supports that guide the flow of fluids 122 towards outlet 206.

In examples, outlet 206 may be disposed within internal chamber 210 of housing 202. Outlet 206 may be an opening that allows fluids 122 to exit flow control device 116. Outlet 206 may be coupled to a control line (discussed further below), wherein fluids 122 may flow through the control line and engage a shuttle valve (discussed further below). In examples, fluids 122 that flowed through the control line may enter the interior of production tubing 112 (i.e., referring to FIG. 1) from the shuttle valve. Alternatively, the shuttle valve may prevent the flow of fluids 122 into the interior of production tubing 112. Without limitations, fluids 122 may be able to flow through outlet 206 depending on the configuration of floats 200.

Floats 200 may block a potential flow path of fluids 122 while in an initial position. Floats 200 may be structures designed to float when disposed in a particular fluid due to having a lower density than said fluid. Floats 200 may be made from any suitable material. Suitable materials may include, but are not limited to, metals, nonmetals, polymers, ceramics, and/or combinations thereof. Without limitations, floats 200 may be made from any material that is less dense than water and/or denser than oil. In examples, floats 200 may be any suitable size, height, and/or shape. Without limitation, a suitable shape may include, but is not limited to, cross-sectional shapes that are circular, elliptical, triangular, rectangular, square, hexagonal, and/or combinations thereof. With reference to FIGS. 2 and 3, floats 200 may have a square cross-sectional shape. With reference to FIG. 4, floats 200 may have a circular cross-sectional shape.

In examples, as best seen on FIG. 5, floats 200 may be a customized shape and rotate about a hinge 500. As fluids 122 (i.e., referring to FIG. 1) enter flow control device 116 through opening 208, fluids 122 may push against floats 200 causing floats 200 to rise. As floats 200 rise due to a density difference, floats 200 rotate about hinge 500. In alternate examples, floats 200 may be able to displace freely, as best seen on FIG. 4. With continued reference to either FIG. 4 or 5, as floats 200 displace due to the introduction of fluids 122, a potential flow path that leads to outlet 206 may become available to fluids 122.

In alternate examples, floats 200 may slide along a wall. Referring to FIGS. 2 and 3, floats 200 may be disposed between a set of walls so as to constrain the path of motion of floats 200 to be one-dimensional. Floats 200 may block a potential flow path for fluids 122 to travel through in order to reach outlet 206. As flow control device 116 rotates, the angular velocity of floats 200 may cause floats 200 to displace outwards in fluids that are less dense, e.g. oil. This may allow access to the potential flow path that leads to outlet 206. As fluids 122 enter internal chamber 210 through opening 208, fluids 122 may travel through the potential flow path and out of flow control device through outlet 206. If fluids 122 include a large concentration of water, the buoyant force of the water may counteract the centrifugal force of the rotation of flow control device 116. Floats 200 may displace towards an inner position, thereby blocking the potential flow path to outlet 206.

Figure 6:
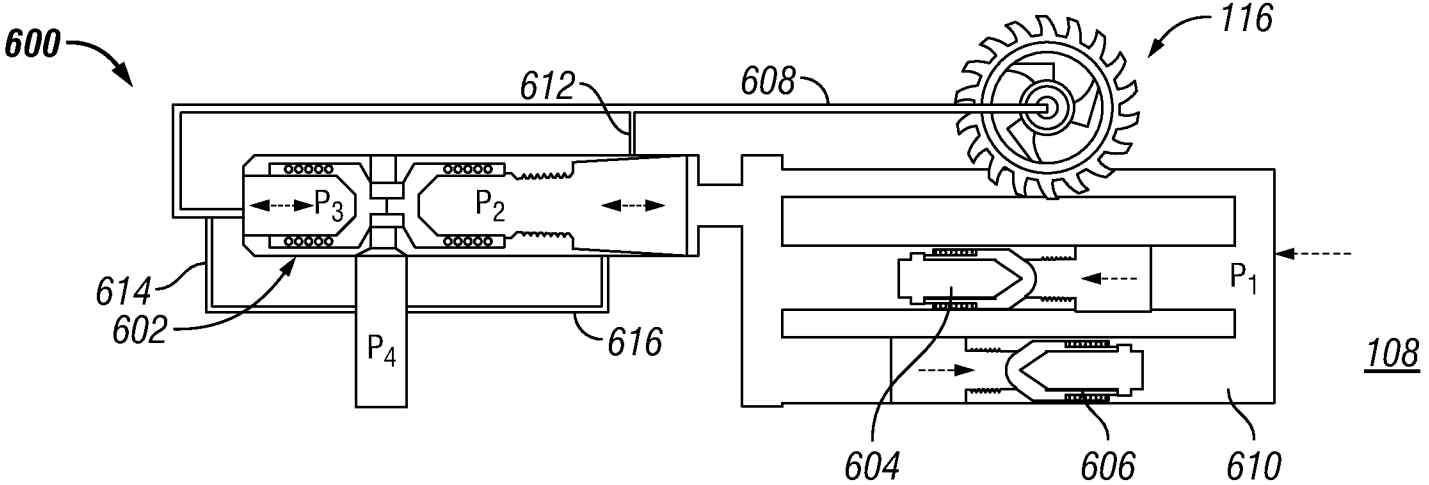
FIG. 6 illustrates a diagram of the fluid flow of fluids from a subterranean formation to the interior of a production tubing.

FIG. 6 illustrates a diagram of the fluid flow of fluids 122 (i.e., referring to FIG. 1) from subterranean formation 108 to the interior of production tubing 112 (i.e., referring to FIG. 1). In examples, there may be a control system 600 disposed on production tubing 112. Control system 600 may control the flow of fluids 122 into and/or out of the interior of production tubing 112. Without limitations, control system 600 may include a regulatory valve 602, a fluid restrictor 604, an injection valve 606 (it should be noted that injection valve 606 may also be referred to as a control line), and a control line 608.

In examples, a portion of flow control device 116 may be disposed within the flow of fluids 122. The flow of fluids 122 may be in a feedback loop 610. In examples, fluid restrictor 604 and injection valve 606 may be disposed within feedback loop 610. Without limitations, fluid restrictor 604 and injection valve 606 may be the same or similar valve in that both fluid restrictor 604 and injection valve 606 allow fluids 122 to flow in one direction. The flow of fluids 122 from subterranean formation 108 may travel through and/or past with flow control device 116 and/or fluid restrictor 604. However, the flow of fluids 122 from subterranean formation 108 may be inhibited by injection valve 606.

The flow of fluids 122 may cause flow control device 116 to rotate. In examples, fluids 122 may enter flow control device 116 as flow control device 116 rotates. If fluids 122 mostly includes of oil, then fluids 122 may exit flow control device 116 and flow through control line 608. Control line 608 may be coupled to regulatory valve 602.

Without limitations, regulatory valve 602 may be a shuttle valve, a ball valve, a diaphragm shuttle valve, a bellows valve, a pilot-operated valve, a pilot-operated check valve, and/or the like. In examples, regulatory valve 602 may include a biasing spring. In certain examples, regulatory valve 602 may be an inverse shuttle valve. If regulatory valve 602 is a type of shuttle valve, the shuttle may be a ball shuttle. In examples, the pressure supplied from control line 608 may be greater than a secondary pressure. The pressure supplied from control line 608 may be equal to the pressure of fluids 122 that are flowing from subterranean formation 108. If the pressure supplied from control line 608 is greater than a secondary pressure, then regulatory valve 602 may actuate to allow fluids 122 to enter the interior of production tubing 112 (i.e., referring to FIG. 1). In certain examples, there may be a restrictor within control system 600 to ensure that the secondary pressure is less than the pressure supplied from the control line 608. In alternate examples, there may be a pressure intensifier within control system 600 to ensure that the pressure supplied from the control line 608 is greater than the secondary pressure.

If fluids 122 mostly includes of water, then there may be little flow of fluids 122 through control line 608. In this example, a balance line 612 may equalize the secondary pressure in regulatory valve 602 with the pressure from control line 608. There may be a weep line 614 that adjusts the pressure supplied by control line 608 to be less than the secondary pressure within regulatory valve 602. In examples, weep line 614 may be a connecting line from control line 608 to the interior of production tubing 112. If the pressure supplied by control line 608 is less than the secondary pressure within regulatory valve 602, then regulatory valve 602 may be actuated to close and restrict the flow of fluids 122 into the interior of production tubing 112.

In certain examples, a complete seal may not be needed when restricting regulatory valve 602. A complete seal may prevent flow control device 116 from rotating. Therefore, there may be a flow line 616 that connects the interior of production tubing 112 to the secondary pressure within regulatory valve 602. In examples, flow line 616 may be a leak around the valve seat or a bypass around the valve seat within regulatory valve 602. Flow line 616 may allow the circulation of the flow of fluids 122 supplied by subterranean formation 108 to continue, thus ensuring the rotation of flow control device 116.

Any of the above described flow control devices 116 may be used to move shuttle valve 700 (e.g., referring to FIG. 7) to open or restrict flow in regulatory valve 602. As discussed below, flow control devices 116 may be configured with any number of floats 200 to allow flow through regulatory valve 602 when fluid may be mostly oil. Additionally, flow control devices 116 may be configured with any number of floats 200 to restrict flow through regulatory valve 602 when fluid is mostly water. FIGS. 7-15, discussed below, illustrated different examples showing the restriction or allowance of fluid through regulatory valve 602.

Figure 7:
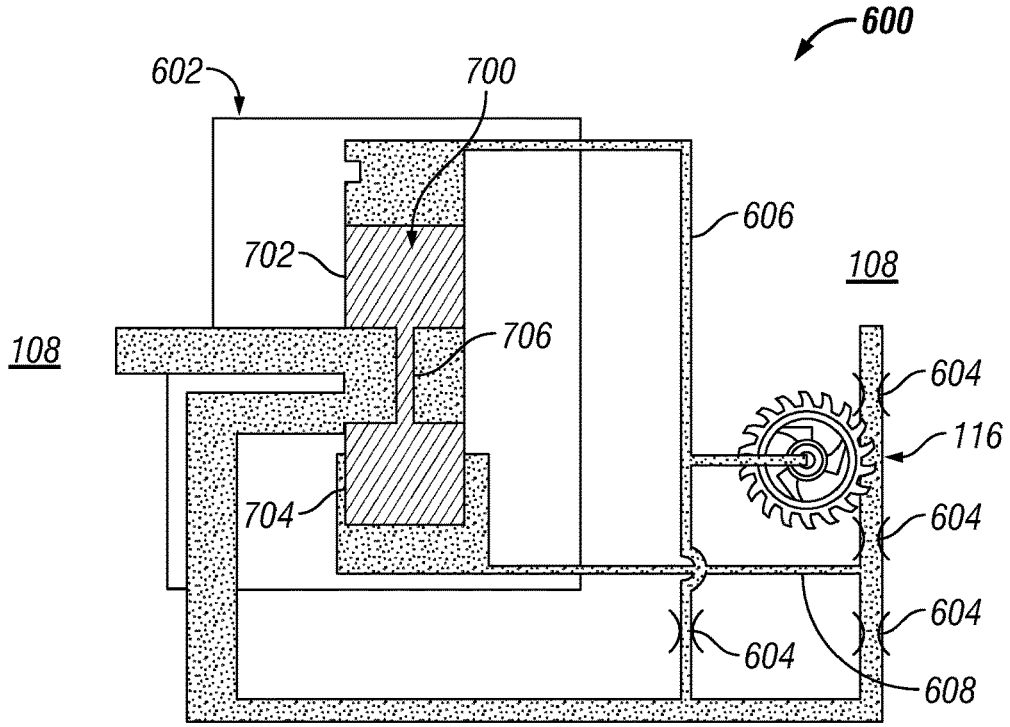
FIG. 7 illustrates a schematic example of a flow system.
Figure 8:
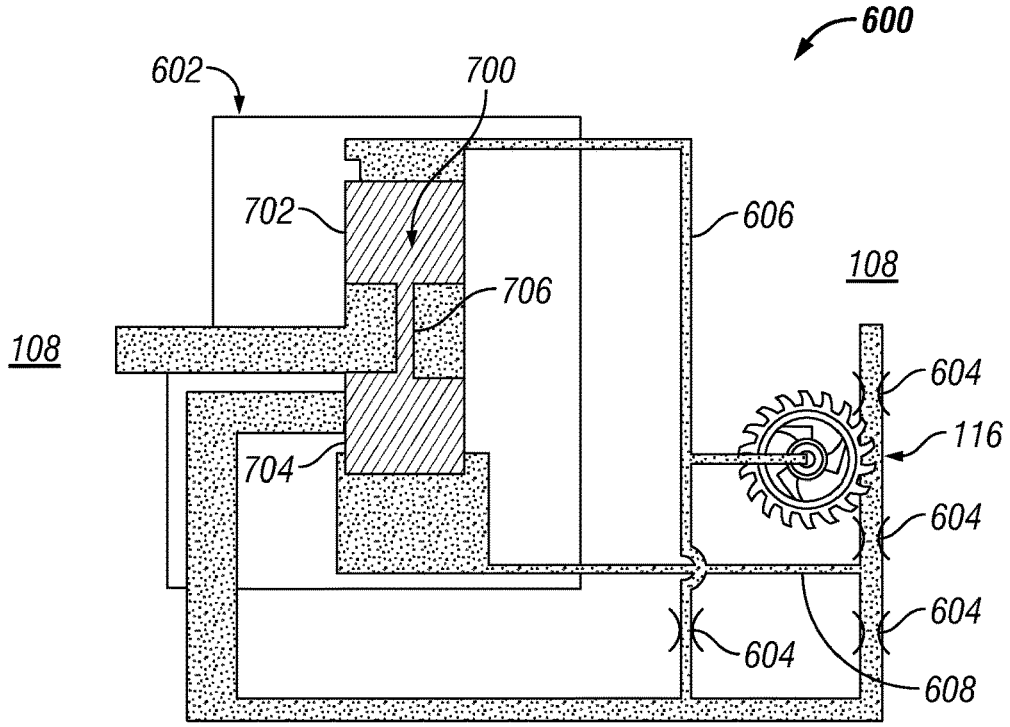
FIG. 8 illustrates another schematic example of the flow system.

FIGS. 7 and 8 illustrate different examples of control system 600. FIG. 7 illustrates control system 600 allowing the flow of fluids 122 (i.e., referring to FIG. 1) straight from subterranean formation 108 into production tubing 112 (i.e., referring to FIG. 1). FIG. 8 illustrates control system 600 preventing the flow of fluids 122 straight from subterranean formation 108 into production tubing 112. Control system 600 depicted in FIGS. 7 and 8 may operate in a similar fashion as those described in previous examples. For examples, as illustrated in FIGS. 7 and 8, a portion of flow control device 116 may be disposed within the flow of fluids 122. The flow of fluids 122 from subterranean formation 108 may travel through and/or past flow control device 116. Prior to engaging with flow control device 116, fluids 122 may pass through fluid restrictor 604. Fluid restrictor 604 may serve to increase velocity and direct fluids 122 to rotate flow control device 116. In examples, there may be a plurality of fluid restrictors 604 within control system 600. Without limitations, fluid restrictor 604 may be a nozzle, a vortex, a change in tubing and/or pipe diameter, fluid diode, and/or other centrifugal fluid selector. Once fluids 122 have passed through fluid restrictor 604, the flow of fluids 122 may cause flow control device 116 to rotate.

Concerning the present examples, regulatory valve 602 may be a pilot operated shuttle valve. Without limitations, the pilot operated shuttle valve may be a valve which allows fluids 122 to flow through from one of two sources. Additionally, the pilot operated shuttle valve may include a shuttle valve 700, wherein shuttle valve 700 is configured to displace when actuated upon by an external pressure. Shuttle valve 700 may be any suitable size, height, and/or shape. As illustrated, shuttle valve 700 may include a first end piece 702 coupled to a second end piece 704 by a connecting rod 706. In examples, first end piece 702 may prevent the flow of fluids 122 from subterranean formation 108 into regulatory valve 602 to be in fluid communication with the flow of fluids 122 from injection valve 606. Further, second end piece 704 may prevent the flow of fluids 122 from subterranean formation 108 into regulatory valve 602 to be in fluid communication with the flow of fluids 122 from an offset line. Connecting rod 706 may serve to affix first end piece 702 to second end piece 704 so that first end piece 702 may displace accordingly with second end piece 704 when one of the two is actuated upon by fluid pressure supplied by injection valve 606 and/or the offset line.

Figure 9:
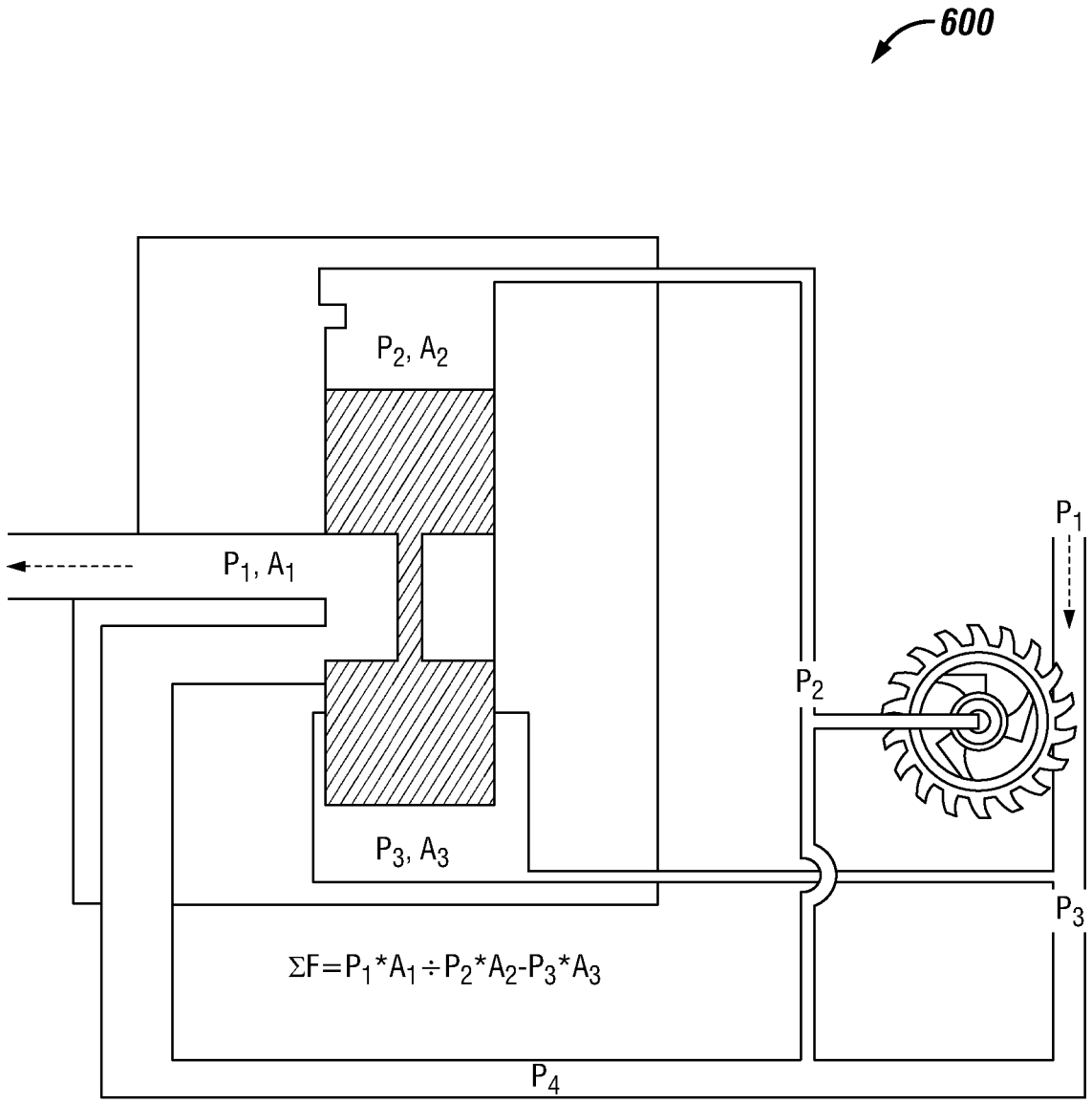
FIGS. 9-15 illustrated different schematic examples of the flow system.
Figure 10:
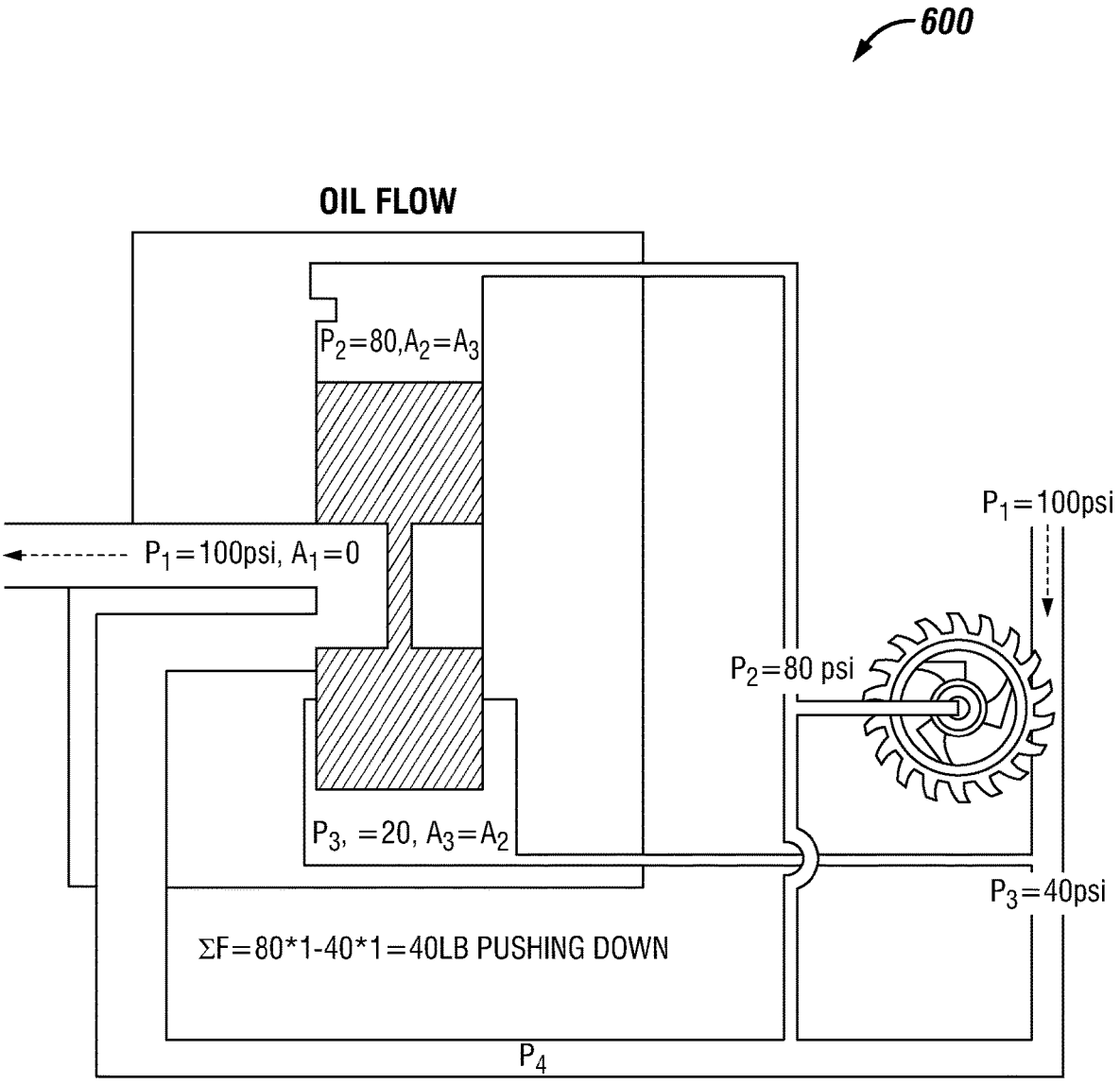
Figure 11:
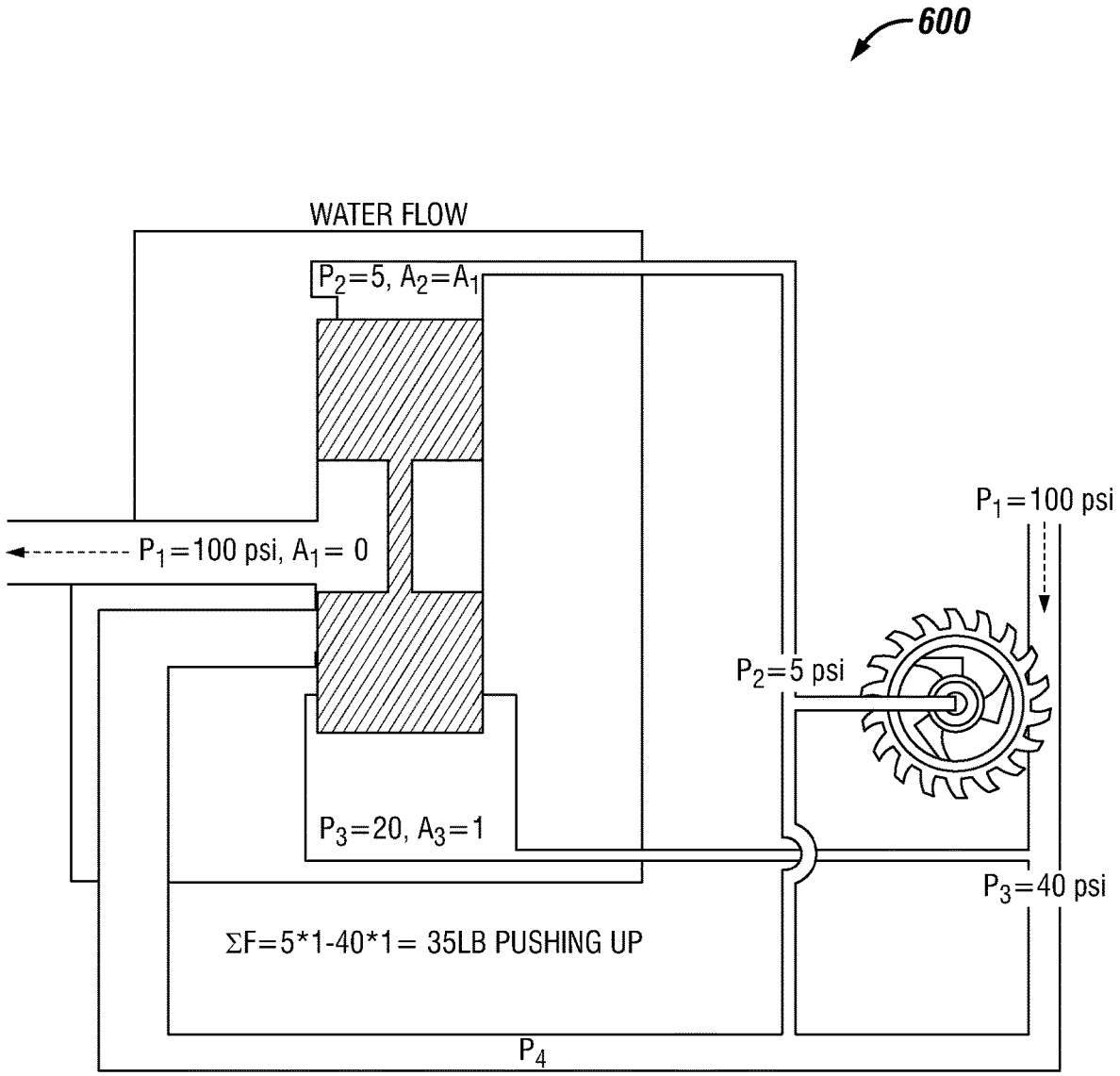
Figure 12:
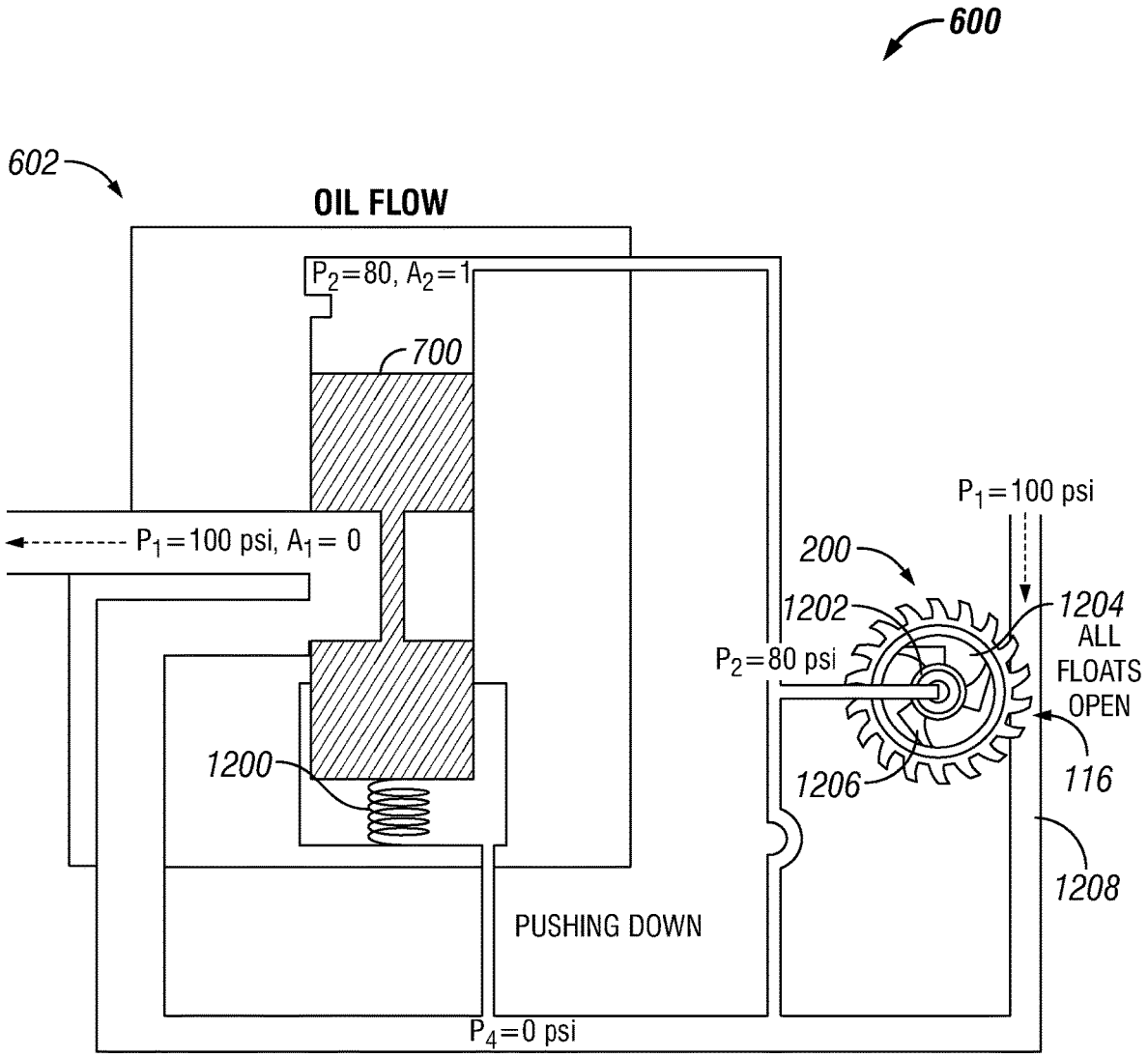

FIG. 9 illustrates pressure measurements area measurements, which may be utilized to control system 600 to operate regulatory valve 602. As illustrated in FIGS. 9-15, P1 is annulus pressure before entering control system 600. P2 is pressure between flow control device 116 and fluid restrictor 604 (the one downstream of it) and is connected to the top of the shuttle valve. P3 is the pressure between one or more fluid restrictors 604 and is connected to the bottom of regulatory valve 602. A2 is the area of shuttle valve 700 that P2 is acting on, A3 is the area of shuttle valve 700 that P3 is acting on. A1 is the net area of shuttle valve 700 that P1 is acting on. In FIG. 9, A2=A3 and A1 is zero because it is acting on first end piece 702 and second end piece 704 equally, so net area is zero. The behavior of regulatory valve 602 in predominantly oil flow and in predominantly water flow is shown in FIGS. 10 and 11, respectfully.

FIG. 10 illustrates predominantly oil flow in control system 600 and FIG. 11 illustrates predominantly water flow in control system 600. Without limitation, in well screen 114 (e.g., referring to FIG. 1) there may be two or more density AICDs (control system 600 including flow control device 116) (D-AICDs). Each D-AICD may have a different density float 200. For example, in a screen joint that may have three D-AICDs, the first D-AICD may have a float 200 that has a density which may allow float 200 to submerge in 75% oil-25% water, the second having a float 200 that has a density which may allow float 200 to submerge in 50% oil-50% water and the third having a density which may allow float 200 to submerge in 25% oil-75% water. In this example when water cut is below 25% control system 600 would allow 100% of the flow. Then when water cut is between 25% and 50% control system 600 would allow fluid flow at about 73.33%. Then between 50% and 75% control system 600 would allow fluid flow at about 46.67% and finally above 75% control system 600 would allow fluid flow at about 20%.

It should be noted that each float 200 may have a different density. Additionally, each float 200 placed in flow control device 116 may be different from each other by about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, or about 95%. The density of each float 200 may be between about 0.5 SG to about 1.5 SG. Specific examples may be 0.8 SG, 1 SG, 1.2 SG, or 1.5 SG.

Figure 16:
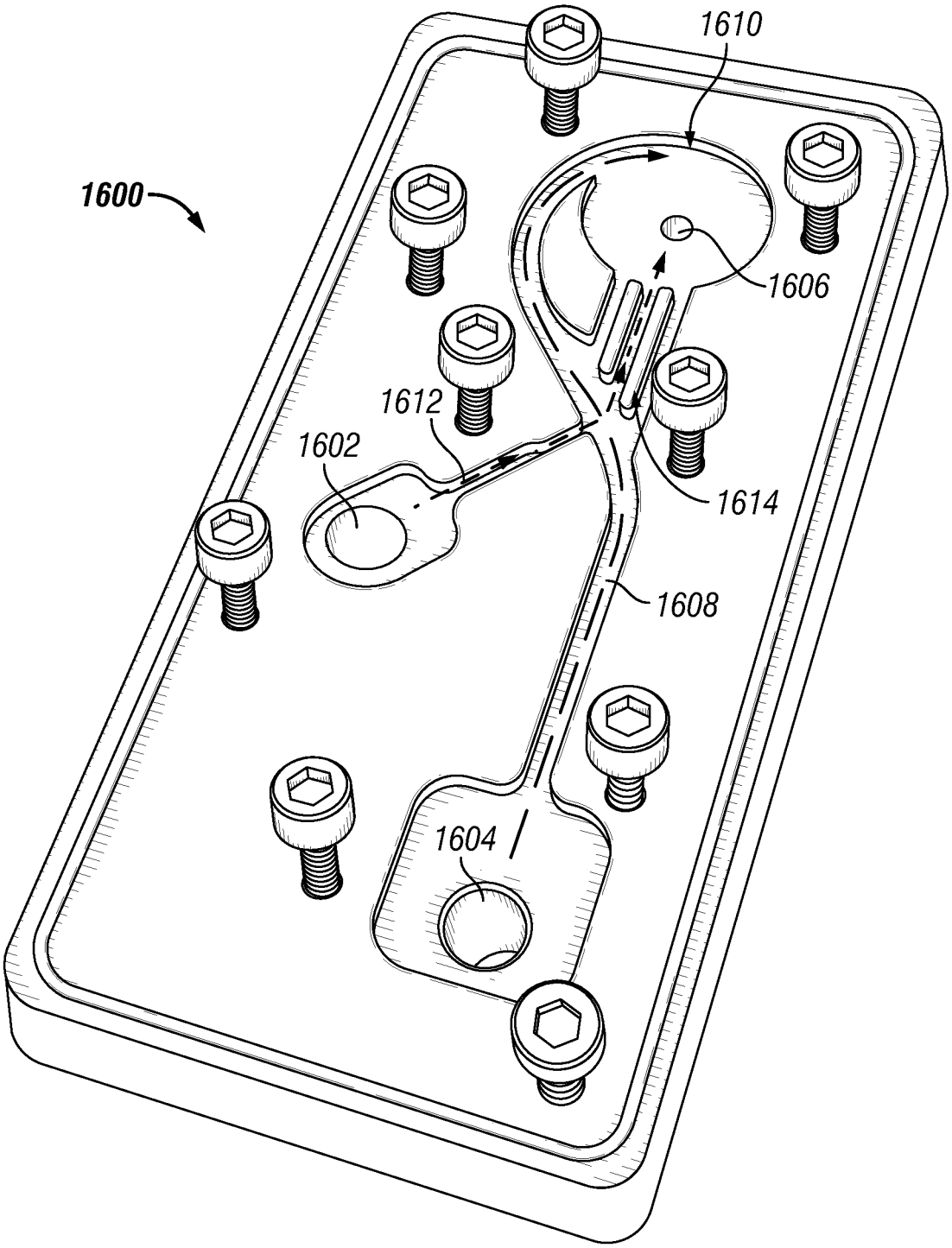
FIG. 16 illustrates a fluid vortex restrictor.

Additionally, each D-AICD may be configured to flow at different flow rates when fully open. For example, following the example above the second D-AICD may be designed to allow double the flow rate of the first and third when all are fully open thus changing the flow percentages at each stage. It should also be noted that a D-AICD may operate without regulatory valve 602 (e.g., referring to FIGS. 10 and 11). Referring back to FIG. 6, flow control device 116 may be used to control a fluid vortex restrictor. As illustrated in FIG. 16, fluid vortex restrictor 1600 may replace shuttle valves, described below. As illustrated in FIG. 16, control jet port 1602 is connected to the output of flow control device 116 (e.g. referring to FIG. 6). Entrance 1604 is connected to the annulus 120 (e.g., referring to FIG. 1) and exit 1606 is production tubing 112 (e.g., referring to FIG. 1). During operations, as water is flowing no fluid flow goes to the control jet port 1602 as one or more floats 200 (e.g., referring to FIG. 5) seal the output of flow control device 116 (e.g., referring to FIG. 6). This may allow fluid from entrance 1604 to traverse long path 1608 and end in vortex 1610 before moving through exit 1606, which may create a relatively large pressure drop resulting in a relatively lower flow rate. Additionally, during operations as oil is flowing, fluid flow travers through control jet port 1602 as one or more floats 200 no longer seal the output of flow control device 116. This flow moves along short path 1612 and intercepts fluid flow along long path 1608 from entrance 1604. Both fluid flow from short path 1612 and long path 1608 move through gate 1614 to exit 1606, which may result in a lower pressure drop and more flow.

Referring back to FIG. 6, flow control device 116 may have different floats 200, for different densities, so that the flow rate in the outlet 206 varies with water cut percentage. As the flow rate is reduced by outlet 206, flow control device 116 may provide a lower pressure in injection valve 606, which may be used to adjust the restriction through fluid restrictor 604. By using different floats 200 in a single flow control device 116, the pressure in injection valve 606, may be configured to have more than two different pressures. This variability in pressures may allow flow control device 116 to be stable in more than two positions (open/closed).

FIGS. 12-15 illustrate additional examples in which flow control device 116 may be used to control a regulatory valve 602. In examples, flow control device 116 may have different density floats 200 so that the pressure in injection valve 606 varies with water cut percentage. For example, flow control device 116 may have a first float 1202, a second float 1204, a third float 1206, or any number of suitable floats (e.g., referring got FIG. 12). In examples below, flow control device 116 may include three floats 200 of different densities and therefore each will open/close at a different water cut percentage. When all floats 200 are open, maximum flow goes in injection valve 606 increasing pressure $P_2$ which pushes shuttle valve 700 against spring 1200 with the maximum displacement and therefore fully opens regulatory valve 602. Without limitation, spring 1200 may be a coil, wave, Belleville or any spring. In examples, spring 1200 may function to exert a pre-selected deflection (amount valve is open) at different pressures (forces F=PA).

Figure 13:
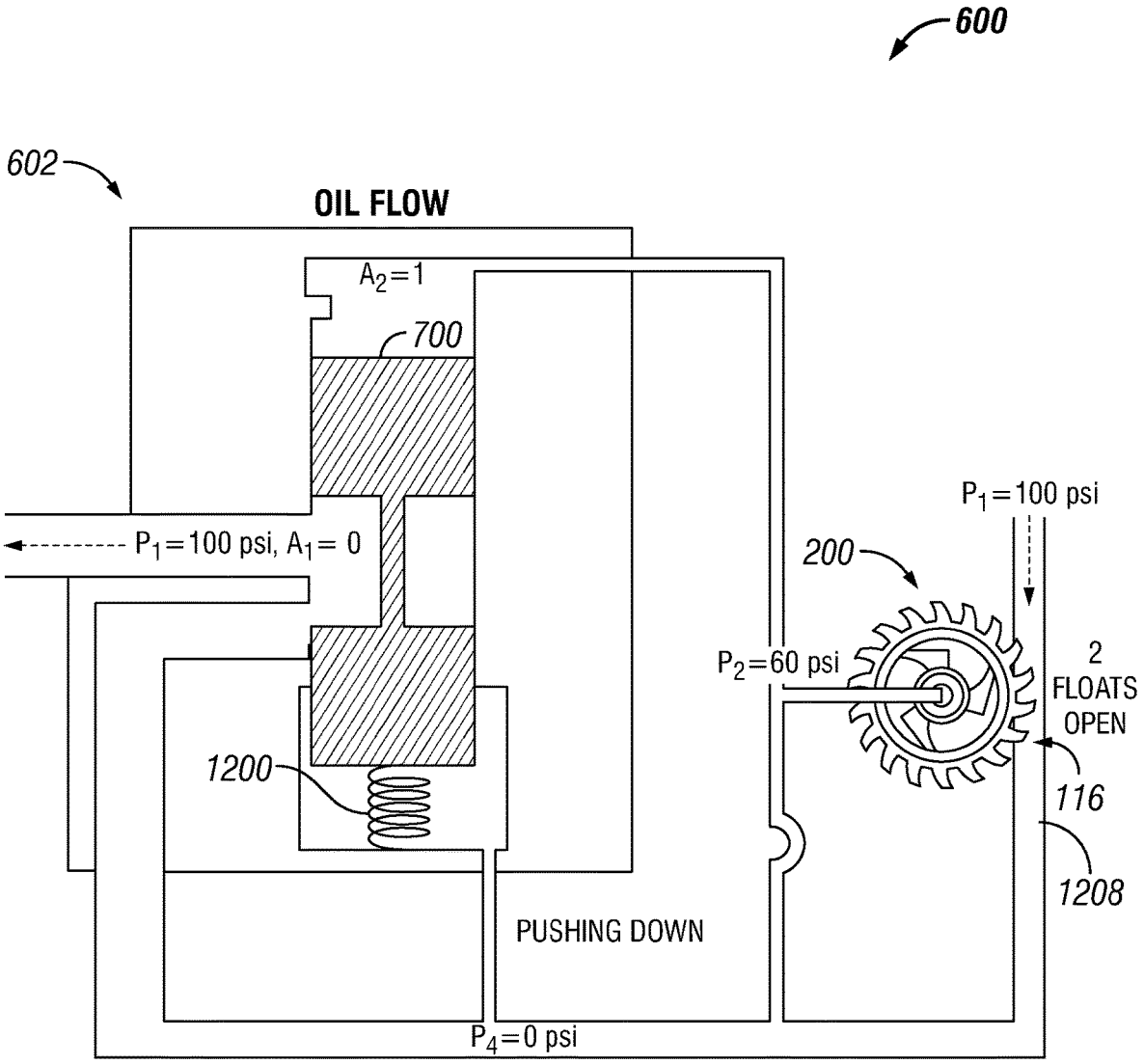
Figure 14:
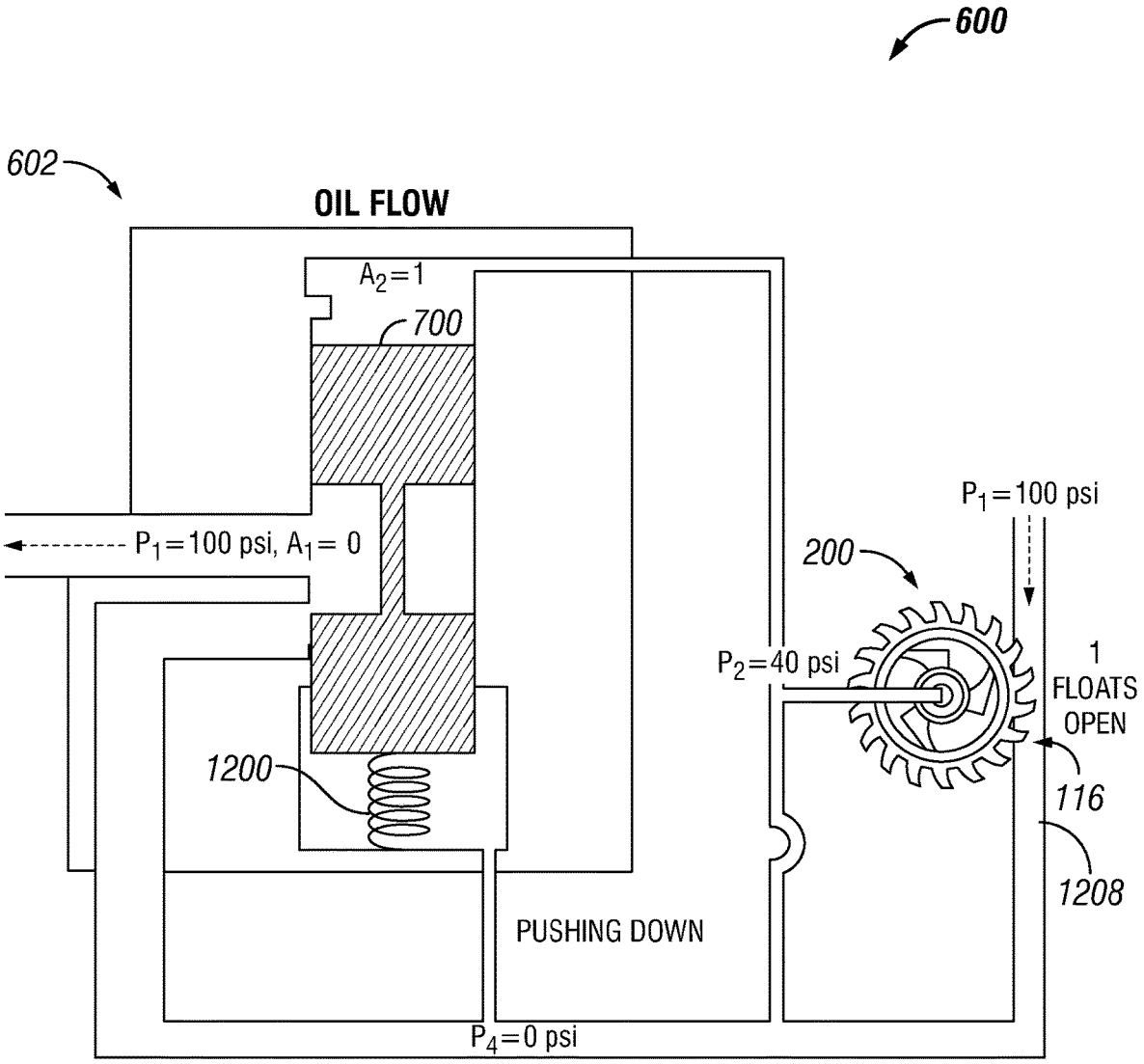
Figure 15:
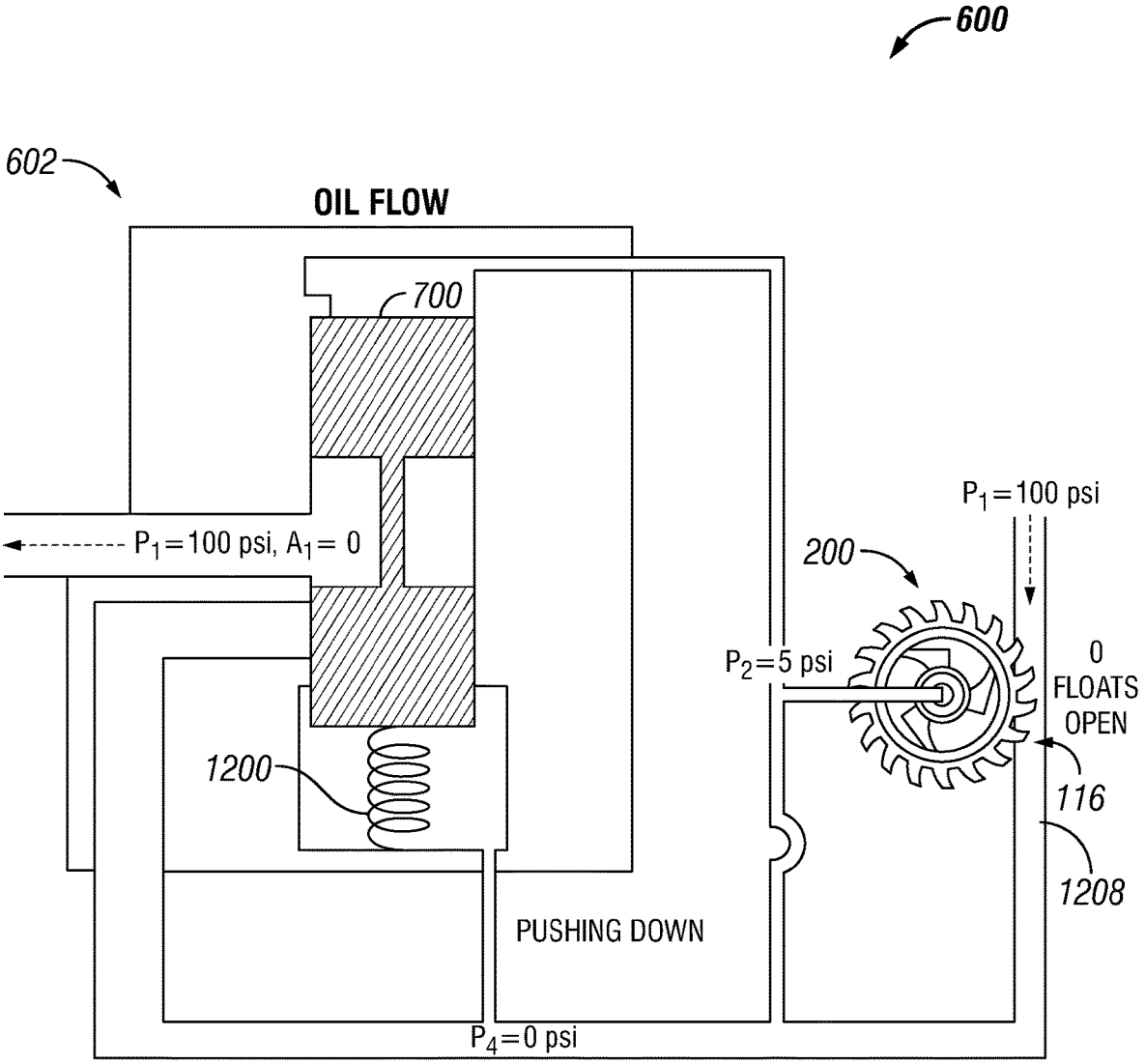

When the water cut reaches a predetermined value, a first float 1202 may close reducing the flow and pressure at $P_2$ and cause shuttle valve 700 to move closer to a closed position, which may restrict the flow of fluid through regulatory valve 602 (e.g., referring to FIG. 13). When water cut increases, a second float 1204 may close further choking main flow (e.g., referring got FIG. 14). Additionally, when water cut reaches third float 1206 all floats 200 may be closed and regulatory valve 602 may close (e.g., referring to FIG. 15)

As discussed above, control system 600 may function and operate off of density within a fluid instead of viscosity. Currently, flow control systems use viscosity to allow and/or restrict the flow of fluid through a regulatory valve. Control system 600 may utilize artificial gravity with floats 200 to allow control system 600 to operate independently. Therefore, control system 600 may be able to toggle back and forth from high restriction to low restriction as the property of a fluid changes downhole.

Statement 1. A fluid control system may comprise a flow control device including one or more floats attached within the flow control device, an outlet within the flow control device that is connected to the one or more floats, a regulatory valve that is fluidly connected to the flow control device, and a blocking element placed within the regulatory valve.

Statement 2. The fluid control system of statement 1, wherein the one or more floats allow for a first oil and water mixture to pass through the outlet.

Statement 3. The fluid control system of statements 1 or 2, further including a fluid restrictor and an injection valve.

Statement 4. The fluid control system of statements 1-3, further including a balance line, a weep line, and a flow line which balance a pressure differential between fluids from a subterranean formation and an interior of a production string.

Statement 5. The fluid control system of statements 1-4, wherein the regulatory valve is a shuttle valve, a ball valve, a diaphragm shuttle valve, a bellows valve, a pilot-operated valve, or a pilot-operated check valve.

Statement 6. The fluid control system of statements 1-5, further including one or more fluid restrictors fluidly attached to the flow control device.

Statement 7. The fluid control system of statement 6, wherein the one or more fluid restrictors are a nozzle, a vortex, a change in a diameter an offset line, or a fluid diode.

Statement 8. The fluid control system of statements 1-6, wherein the one or more floats have a specific gravity of about 0.8 to about 1.5.

Statement 9. An autonomous flow control system may comprise a first flow control device attached to a production tubing at a first location in a wellbore, a second flow control device attached to the production tubing at a second location in the wellbore, a first set of floats attached within the first flow control device, and a second set of floats attached within the second flow control device.

Statement 10. The autonomous flow control system of statement 9, wherein the first set of floats allow for a first oil and water mixture to pass through a first outlet attached to the first flow control device.

Statement 11. The autonomous flow control system of statements 9 or 10, wherein the second set of floats allow for a second oil and water mixture to pass through a second outlet attached to the second flow control device.

Statement 12. The autonomous flow control system of statements 9-11, further including a first regulatory valve fluidly attached to the first flow control device.

Statement 13. The autonomous flow control system of statement 12, wherein the first regulatory valve is a shuttle valve, a ball valve, a diaphragm shuttle valve, a bellows valve, a pilot-operated valve, or a pilot-operated check valve.

Statement 14. The autonomous flow control system of statements 9-12, further including a second regulatory valve fluidly attached to the second flow control device.

Statement 15. The autonomous flow control system of statement 14, wherein the second regulatory valve is a shuttle valve, a ball valve, a diaphragm shuttle valve, a bellows valve, a pilot-operated valve, or a pilot-operated check valve.

Statement 16. The autonomous flow control system of statements 9-12 or 14, wherein the first flow control device and the second flow control device further including a fluid restrictor and an injection valve.

Statement 17. The autonomous flow control system of statement 9-12, 14, or 16, wherein the first flow control device and the second flow control device further including a balance line, a weep line, and a flow line which balance a pressure differential between fluids from a subterranean formation and an interior of the production tubing.

Statement 18. The autonomous flow control system of statement 9-12, 14, 16, or 17, further including one or more fluid restrictors fluidly attached to the first flow control device and the second flow control device.

Statement 19. The autonomous flow control system of statement 18, wherein the one or more fluid restrictors are a nozzle, a vortex, a change in a diameter an offset line, or a fluid diode.

Statement 20. The autonomous flow control system of statement 9-12, 14, or 16-18, wherein the first set of floats and the second set of floats have a specific gravity of about 0.8 to about 1.5.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A fluid control system, comprising:

a flow control device including one or more floats attached within the flow control device, the flow control device comprising protrusions operable to rotate upon receiving fluid;

an outlet within the flow control device that is connected to the one or more floats;

a regulatory valve that is fluidly connected to the flow control device; and a blocking element placed within the regulatory valve.

2. The fluid control system of claim 1, wherein the one or more floats allow for a first oil and water mixture to pass through the outlet.

3. The fluid control system of claim 1, further including a fluid restrictor and an injection valve.

4. The fluid control system of claim 1, further including a balance line, a weep line, and a flow line which balance a pressure differential between fluids from a subterranean formation and an interior of a production string.

5. The fluid control system of claim 1, wherein the regulatory valve is a shuttle valve, a ball valve, a diaphragm shuttle valve, a bellows valve, a pilot-operated valve, or a pilot-operated check valve.

6. The fluid control system of claim 1, further including one or more fluid restrictors fluidly attached to the flow control device.

7. The fluid control system of claim 6, wherein the one or more fluid restrictors are a nozzle, a vortex, a change in a diameter in an offset line, or a fluid diode.

8. The fluid control system of claim 1, wherein the one or more floats have a specific gravity of about 0.8 to about 1.5.

9. An autonomous flow control system comprising;

a first flow control device attached to a production tubing at a first location in a wellbore, the flow control device comprising protrusions operable to rotate upon receiving fluid;

a second flow control device attached to the production tubing at a second location in the wellbore;

a first set of floats attached within the first flow control device; and a second set of floats attached within the second flow control device.

10. The autonomous flow control system of claim 9, wherein the first set of floats allow for a first oil and water mixture to pass through a first outlet attached to the first flow control device.

11. The autonomous flow control system of claim 9, wherein the second set of floats allow for a second oil and water mixture to pass through a second outlet attached to the second flow control device.

12. The autonomous flow control system of claim 9, further including a first regulatory valve fluidly attached to the first flow control device.

13. The autonomous flow control system of claim 12, wherein the first regulatory valve is a shuttle valve, a ball valve, a diaphragm shuttle valve, a bellows valve, a pilot-operated valve, or a pilot-operated check valve.

14. The autonomous flow control system of claim 9, further including a second regulatory valve fluidly attached to the second flow control device.

15. The autonomous flow control system of claim 14, wherein the second regulatory valve is a shuttle valve, a ball valve, a diaphragm shuttle valve, a bellows valve, a pilot-operated valve, or a pilot-operated check valve.

16. The autonomous flow control system of claim 9, wherein the first flow control device and the second flow control device further including a fluid restrictor and an injection valve.

17. The autonomous flow control system of claim 9, wherein the first flow control device and the second flow control device further including a balance line, a weep line, and a flow line which balance a pressure differential between fluids from a subterranean formation and an interior of the production tubing.

18. The autonomous flow control system of claim 9, further including one or more fluid restrictors fluidly attached to the first flow control device and the second flow control device.

19. The autonomous flow control system of claim 18, wherein the one or more fluid restrictors are a nozzle, a vortex, a change in a diameter in an offset line, or a fluid diode.

20. The autonomous flow control system of claim 9, wherein the first set of floats and the second set of floats have a specific gravity of about 0.8 to about 1.5.

* * * * *